US006299699B1

(12) United States Patent
Porat et al.

(10) Patent No.: US 6,299,699 B1
(45) Date of Patent: Oct. 9, 2001

(54) POOL CLEANER DIRECTIONAL CONTROL METHOD AND APPARATUS

(75) Inventors: Joseph Porat, North Caldwell; Eitan Hanan, Teaneck; Michael Hebel, West New York, all of NJ (US)

(73) Assignee: Aqua Products Inc., Cedar Grove, NJ (US)

( * ) Notice: Subject to any disclaimer, the term of this patent is extended or adjusted under 35 U.S.C. 154(b) by 0 days.

(21) Appl. No.: 09/285,020

(22) Filed: Apr. 1, 1999

(51) Int. Cl.[7] ..... E04H 4/16; B08B 1/00
(52) U.S. Cl. ..... 134/6; 15/1.7; 15/49.1
(58) Field of Search ..... 15/1.7, 49.1

(56) References Cited

U.S. PATENT DOCUMENTS 5,208,521 * 5/1993 Aoyama ..... 15/1.7
5,256,207 * 10/1993 Summer ..... 15/1.7
5,309,592 * 5/1994 Hiratsuka ..... 15/49.1
5,454,129 * 10/1995 Kell ..... 15/1.7
5,507,058 * 4/1996 Minami ..... 15/1.7
5,569,371 * 10/1996 Perling ..... 15/1.7
6,039,886 * 3/2000 Henkin ..... 15/1.7

* cited by examiner

*Primary Examiner*—Randall E. Chin
(74) *Attorney, Agent, or Firm*—Abelman, Frayne & Schwab

(57) ABSTRACT

A pool cleaner and method for its operation provides for the efficient and systematic cleaning of the bottom of a rectilinear pool or tank in a controlled geometric pattern of parallel paths transversed between a pair of opposing sidewalls by having the pool cleaner complete a 180° U-turn at each wall, and when an end wall is reached, to effect a 90° turn and commence a similar pattern of parallel paths between the pair of end walls. A microprocessor, or programmable electronic controller, responds to signal-generating sensors that are activated at the pool's sidewalls, and to a program that also repositions the cleaner should it become blocked by a corner or other obstacle.

17 Claims, 6 Drawing Sheets

POOL CLEANER DIRECTIONAL CONTROL METHOD AND APPARATUS

FIELD OF THE INVENTION

This invention relates to the control of the pattern and direction of movement of robotic swimming pool and tank cleaners.

BACKGROUND OF THE INVENTION

Pool and tank cleaners of the prior art generally operate in a random pattern of movement across the bottom of the pool or tank. The forward or advancing end of the cleaner can either be stopped and reversed at the sidewall of the pool, or be designed to climb the sidewall until the leading edge of the advancing end is at the waterline, after which the cleaner reorients itself and descends the sidewall and moves across the bottom of the pool along a different line of travel. By criss-crossing the pool for a sufficient period of time and along a sufficient number of varied paths, all, or substantially all, of the bottom of the pool is by the passing cleaner.

In very large rectangular pools, e.g., Olympic-sized pools maintained by educational institutions, water parks and municipalities, a substantial amount of time is required to assure that the cleaner following a random pattern will clean the entire bottom surface of the pool. It can arise that the cleaning cycle is longer than the time that can be allotted for this maintenance activity.

One solution that has been offered to expedite the cleaning of the pool is to join two or even three individual pool cleaners into a unitary parallel assembly in order to cover a path that is twice the width (for the double assembly) as would be covered by a single moving cleaner. This cleaner is also designed to operate in a random pattern. However, there are difficulties associated with the handling, transportation, storage and control of these double (or larger) units that present drawbacks to their use. These oversized units are heavy and can be difficult to remove from the pool due to their bulk and weight. The floating power cord is also necessarily long and heavy and subject to twisting and can interfere with the programmed pattern of the cleaner.

Another solution that has been developed for producing a more or less predictable scanning pattern by a pool cleaner is a gyroscopically controlled guidance system. This system is expensive to construct and must also be oriented at a prescribed starting point. Thereafter the unit follows a series of straight lines, the drive motors being controlled by the gyroscope, which result in a zig-zag pattern. The principal drawback is the cost of the unit.

It is therefore an object of this invention to provide a method and apparatus for controlling the direction and pattern of a pool cleaner across the bottom of a pool or tank in order to minimize the time required to clean the entire bottom surface of the pool.

It is another object of this invention to provide a pool cleaner that follows a regular geometric pattern that is parallel to the sidewalls of a rectilinear pool, and also a pattern in which subsequent paths traversing the area between the sidewalls are not only parallel, but also closely spaced to each other.

Yet another object of the invention is to provide a method and apparatus in which the pool cleaner first traverses a plurality of parallel paths from side to side, and then when it reaches an end wall, turns and begins traversing a plurality of parallel, closely-spaced paths that extend from one end of the pool to the other.

Another object of the invention is to provide a method an apparatus for controlling the movement of a robotic pool cleaner so that the cleaner's regular pattern is not interrupted or adversely affected by its encounters with the corners or other obstructions in or along the side walls of the pool being cleaned.

A still further object of the invention is to provide a robotic pool cleaner that is programmed to clean a rectilinear pool or tank in the most efficient manner possible, and to thereby reduce operating and maintenance expenses.

Yet another object of the invention is to provide a robotic pool cleaner that follows a regular geometric pattern and whose motion is controlled so that the power supply cord does not interfere with the intended pattern due to a twisting or coiling of the cord.

It is yet another object of the invention to provide a pool cleaner that can accomplish the above objects at a cost that is relatively less expensive than the prior art gyroscopically-controlled cleaners.

SUMMARY OF THE INVENTION

The above objects, as well as other advantages, are achieved with the improved pool cleaner of the invention in which a robotic pool cleaner comprising a pair of separate traction means disposed at either end of the cleaner housing has each of the traction means mounted for independent rotation and each set of traction means on the opposing side of the cleaner are powered by separate first and second traction motors. The speed and/or direction of rotation of each of the separate motors is directed by a programmable controller, the controller also being responsive to sensor signals received from one or more sensors mounted on, or in, the cleaner. In one preferred embodiment, the controller comprises the following means to accomplish the indicated functions:

- means for activating the traction motors to move the cleaner across the bottom of a pool or tank;
- means responsive to a signal from said one or more sensors to stop the traction motors when the forward end of the cleaner is adjacent a first sidewall of the pool;
- means for activating the first traction motor while the cleaner is proximate the first sidewall;
- means responsive to a signal from said one or more sensors to stop the first traction motor when the advancing opposite end of the cleaner is proximate the first sidewall; and
- means for activating both traction motors to move the cleaner in a direction away from the first sidewall towards another sidewall.

It an especially preferred embodiment of the invention described above, the controller also comprises the following:

- means for activating the second traction motor to move the traction means in a direction opposite to the direction of the first traction motor for a prescribed period of time until the cleaner has turned approximately 90° from the side wall; and
- means responsive to a timer for stopping the second traction motor when the cleaner has turned approximately 90°.

In another preferred embodiment, where the pool cleaner is adapted to climb the side wall of the pool the controller further comprises:

- means responsive to said one or more sensors to stop the traction motor when the cleaner is at a prescribed angle from the horizontal;

means for activating both traction motors to return to cleaner to the bottom wall of the pool;

means responsive to said one or more sensors to stop the traction motors when the cleaner is on the bottom wall of the pool; and means as described above to activate the traction motors to turn the cleaner and move it in a direction away from the first side wall towards another side wall.

It is to be understood that in the context of this description the pool cleaner is of generally symmetrical construction and that the traction means are mounted for rotation on axles that are positioned at opposite ends of the cleaner. As used herein, the term "advancing end" refers to the end of the cleaner in the direction of movement. This will include the pivoting or rotating motion of the cleaner as it turns to reverse its orientation along a given sidewall. Thus, once the cleaner has come to a stop proximate a sidewall, what had previously been the trailing or after end becomes the advancing end for the purposes of the turn.

The power source can be batteries contained in a floating water-tight battery container connected by a power cord. In order to clean a large, e.g., Olympic-sized pool, a conventional electrical power source external to the pool is likely to be required. As will be apparent to one of ordinary skill in the art, the random turning of the cleaner over a prolonged period of time can cause the floating power cord to become tightly coiled and/or twisted to such an extent that it acts as a tether and interferes with the movement of the cleaner, as by pulling the cleaner off of its programmed straight-line course.

In order to avoid the problems attendant this twisting or coiling of the cord, in the method and apparatus of the invention, the cleaner is programmed to follow a course by which a turn in one direction that tends to induce a right-hand twist in the power supply cord is followed by a turn in a direction that tends to induce a left-hand twist in the cord. In this way, no significant twisting of the power cord occurs with the practice of the invention.

The traction means can take the form of generally cylindrical roller brushes, endless traction belts or wheels. The preferred form of traction means are roller brushes, which brushes can be fabricated from expanded polymeric foam or from a molded flexible polymer sheet that is formed into a generally cylindrical configuration. In addition to providing the surface contact to move the cleaner across the bottom of the pool, the roller brushes also dislodge dirt and debris from the surface that is drawn up by the water pump through the filter media to be entrained inside of the cleaner.

The number and placement of the sensors that generate signals that are transmitted to the programmable controller is dependent upon the type of sensor employed. For example, if infrared sensors are used, a single sensor can be placed on either end of the cleaner body. The infrared sensor will detect the reflection of an infrared beam from the sidewall that the cleaner approaches and transmit a signal to the controller to switch off power to the traction motors or motor. In another embodiment, a single flow meter is mounted on the exterior housing of the cleaner and functions by transmitting a signal when the flow through the meter ceases after the advancing movement of the cleaner is stopped by a sidewall. Similarly, a mechanical or electro-mechanical sensor in the form of a rod or shaft that projects beyond the leading edge of the advancing cleaner and that is caused to move is retracted by contact with the wall when the cleaner approaches a sidewall, which movement results in a signal being transmitted to the controller.

In one preferred embodiment, a magnetic field sensor is employed either in conjunction with a free-running wheel that moves in contact with the bottom surface of the pool as the cleaner traverses, or as part of a flow meter or other type of mechanical sensor. As will be explained in more detail below, a magnetic field sensor is preferred because it can also determine whether the cleaner has completed a full U-turn of 180°, or only some lesser turn.

In the case of a cleaner that is designed to climb the side wall of the pool, the sensor can be a mercury switch which transmits a signal when the body of the cleaner reaches a prescribed angle to the horizontal, e.g., from about 30° to about 70°. The prescribed angle must be greater than the angle of any portion of the bottom of the pool that slopes from the shallow to the deeper end of the pool. When the controller receives the signal from the mercury switch, it returns the cleaner to the bottom of the pool, where it stops the cleaner in response to a further signal.

From the above, it will be understood that the cleaner may approach the corner of a pool at a distance along the sidewall so that the cleaner completes more than a 90° turn, but less than a 180° turn, and so that its advance is thereby halted, the cleaner facing into the corner at, e.g., a 45° angle with the opposing forward corners of the pool cleaner housing against the side and end walls of the pool.

If the cleaner were to follow the sequence of steps described above, both drive motors would be activated and the cleaner would leave the corner at an angle (e.g., 45°), and thereafter would no longer be following a path that was parallel to a side or end wall of the pool. In anticipation of this eventual contingency, in one preferred embodiment, the improved cleaner of the invention is provided with a magnetic sensor that is calibrated to detect the approximate number of degrees achieved by the cleaner in turning away from a sidewall. In an especially preferred embodiment of such a magnetic sensor, a free-running contact wheel is positioned along the central longitudinal axis of the cleaner and bias-mounted so that it remains in constant contact with the bottom of the pool as the cleaner commences a turn from the stopped position- The contact wheel is fabricated with a plurality of spaced-apart magnetic elements about its periphery and a magnetic field reader is positioned approximate the periphery of the wheel. A previously determined but arbitrary number of magnetic elements will pass the counter when the cleaner makes a turn of 180°, for example, about 100; if the cleaner completes only a turn of 90°, about 50 elements will have passed the counter; and if the cleaner turns into a corner so that a turn of approximately 135° is completed, approximately 75 magnetic elements will have turned past the counter. It is to be understood that the magnetic counter is reset to "zero" after the cleaner has stopped in its advancement, so that the counter starts from zero when the cleaner begins its turning maneuver.

In the event that a 90° turn is completed, e.g., a count of 50 on the sensor, the controller is programmed to respond by powering both motors to drive the traction means away from the wall, thereby causing the cleaner to commence a path that is parallel to the adjacent sidewall from which it has just turned away and at right angles to the prior paths traversed.

If the magnetic counter passes the 90° mark (e.g., a count greater than 50), but does not achieve the full 180° turn (e.g., a count of less than 100), the controller is programmed to first stop the drive motor for the advancing traction means and to then reverse the direction of the drive motor until the magnetic counter indicates that the cleaner is at 90° to its original starting position, and is now parallel to the sidewall that it has just left. For example, if the counter reaches 80, the traction means is run in reverse until the counter reaches 50 (indicating a 90° turn from the original starting position), after which the cleaner is halted in a position that is parallel to the side wall and perpendicular to the previous travel path. The controller then activates the drive motors for both traction means to move the cleaner parallel to the sidewall and at right angles to its former traversing paths.

If the cleaner is equipped at each end with a directionally sensitive infrared source and reflective signal-generating sensor positioned on the central longitudinal axis of the unit, no signal will be generated when the cleaner is stopped in a corner, or by an obstacle that prevents the cleaner from drawing near to the wall with its longitudinal axis essentially normal to the wall. When the controller initiates the U-turn maneuver, it also starts a timer. If the controller does not receive a wall sensor signal within a first prescribed period of time, e.g., fifteen seconds, the controller deactivates the traction motor(s). The controller then activates at least one of the traction motors to reverse the direction of movement of the cleaner for a second prescribed period of time, which is less than the first prescribed period of time, e.g., five seconds, to move and reorient the cleaner to a position that is parallel to the wall from which the U-turn was initiated. Thereafter, the controller activates both traction motors to advance the cleaner in a path that is at right angles to its prior movements traversing the bottom of the pool and parallel to the side wall from which it last departed.

In a preferred embodiment of the method described above, the controller activates the sensor for the first prescribed period of during which the cleaner is programmed to complete the U-turn. This is done in order to eliminate false signals from a sensor, such as an IR sensor, while the cleaner is turning. The sensor is reactivated after the prescribed period of time, and if it is facing a wall, it sends a signal received by the controller and the controller activate the traction motors to move the cleaner away from the wall in a straight line.

In a cleaner equipped with one or more mercury switches, the controller initiates a timer when the cleaner starts the U-turn maneuver and if a sensor signal is not received after a prescribed period of time, e.g., fifteen seconds, the controller deactivates the traction motor and starts the reverse movement cycle to back the cleaner out of the comer or other blocked position.

In accordance with conventional design parameters, the improved cleaner is of approximately neutral buoyancy. The cleaner is provided with one or more water pumps which draw dirt and debris up from the surface being cleaned, and discharge the water through one or more openings in a direction that produces a force that maintains the cleaner in contact with the surface being traversed.

As the cleaner accumulates dirt and debris in its filter system, the cleaner becomes less buoyant, and the force of the water discharged vertically from the pump can impede or interfere with the pivotal turning of the cleaner during its repositioning when it reaches a side or end wall of the pool or tank. In order to obviate this possibility, the controller is provided with means to reduce the power to the pump motor so that the volumetric discharge and therefore the downward force on the cleaner is reduced during the turning operation. In a preferred embodiment, the volumetric discharge or measurable force is reduced during turns to approximately 20% of the force normally produced during the cleaning operation.

BRIEF DESCRIPTION OF THE DRAWINGS

The invention will be further described with reference to the following in which like elements are referred to by the same number, and where.

DETAILED DESCRIPTION OF THE PREFERRED EMBODIMENTS OF THE INVENTION

Figure 1:
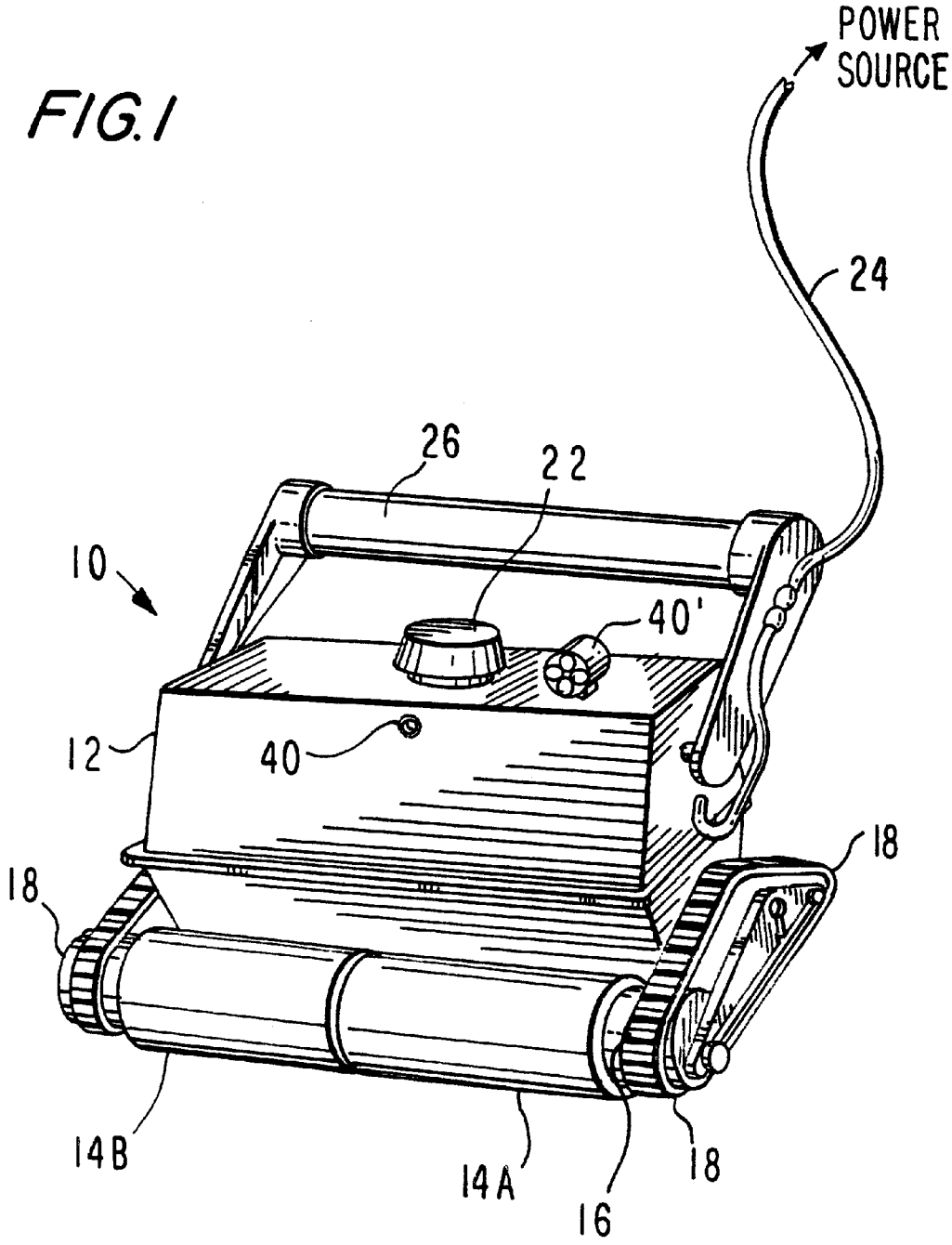
FIG. 1 is a top perspective view of one embodiment of a pool cleaner in accordance the invention.

The above objects and other advantages are provided by the invention, which will be described with reference to FIG. 1 where the pool cleaner, generally referred to as 10, is comprised of a cover or body-housing 12 on which are mounted independently rotatable traction means 14A and 14B. In the embodiment of FIG. 1, the traction means 14 are roller brushes fabricated from a molded elastomeric polymer such as PVA that provides good traction for cleaner against ceramic tile pool bottoms and sidewalls, if the cleaner designed to ascend the sidewalls of a pool or tank. The roller brushes can also be constructed from an assembly of expanded foam and other materials that are well known in the art.

Figure 2:
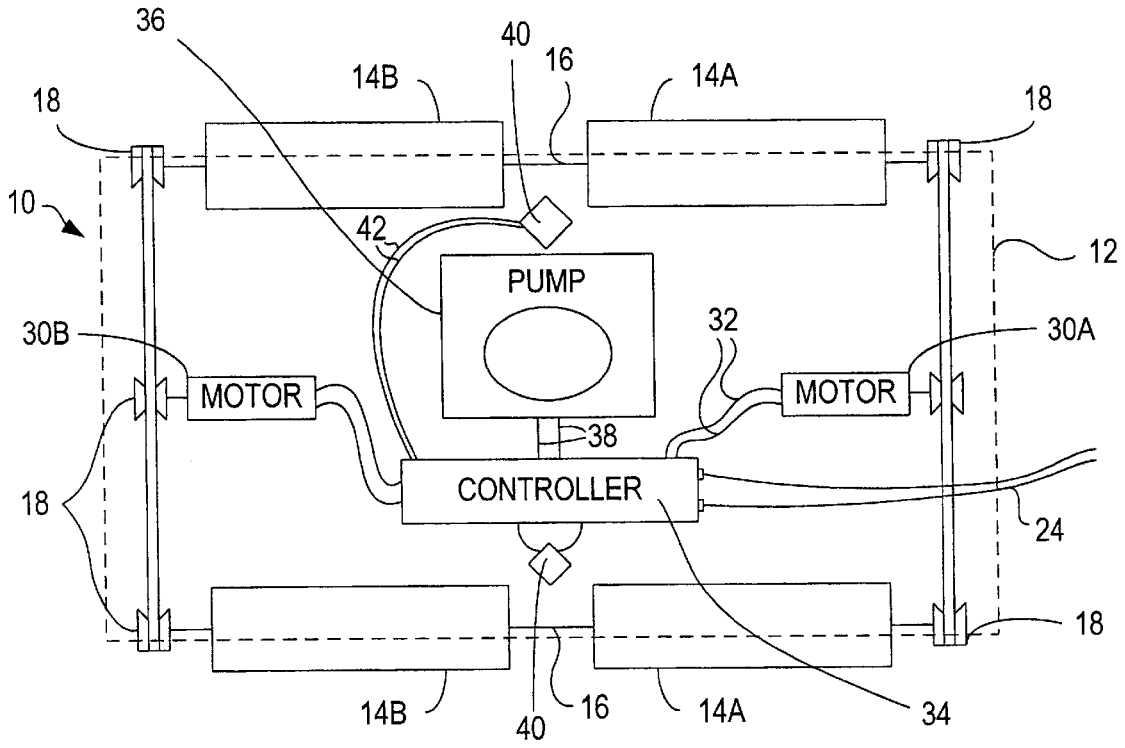
FIG. 2 is schematic plan view of the elements comprising the cleaner of FIG. 1.

With further reference to FIG. 1 and the schematic plan of FIG. 2, the traction means 14 are mounted for rotation on axles 16 extending transversely across either end of the cleaner and terminating in pulleys 18, which in this embodiment are outboard of the rollers 14. Pulleys 18 are preferably provided with transverse grooves and drive belts 20 with corresponding lugs to engage the grooves to provide a non-slip power train from variable speed motor 30, preferably a DC brushless motor. Because of the frequent stopping and starting of the traction motors 30, as well as their changes in direction, it is important that the drive train between the traction motors and the traction means 14 without slipping and overrun.

With continuing reference to FIG. 1, cover 12 is provided with a pump discharge aperture 22 by means of which the filtered water expelled by the pump produces an opposing force that maintains the traction means 14 in contact with the bottom, or in another preferred embodiment, the sidewall, of the pool. A buoyant power cord 24 is shown attached to handle 26 and extends from an external power source, not shown, to the interior of the cleaner housing 12.

Returning to FIG. 2, independent traction motors 30A and 30B drive traction means 14A and 14B, respectively. The speed and/or direction of motors 30 is controlled by a microprocessor or programmable electronic controller 34 that is connected to motors by conductors 32 and also in a preferred embodiment to pump 36 by conductors 38. Controller 34 is programmed to respond to signals received from one or more signal-generating sensors 40 via conductors 42.

An especially preferred configuration of pool cleaner that can be modified and adapted for use in the invention is sold by Aqua Products Inc. of Cedar Grove, N.J. under the designation and trademark ULTRA-MAX. This cleaner is provided with a pair of power-driven traction rollers that are axle-mounted at each end of the cleaner. In the embodiment required for the practice of the invention, the traction means must be separately mounted so that the rollers at the opposite ends on one side of the cleaner are driven by a separately powered and controlled traction motor. In other words, the front and rear traction means on the right side of the cleaner are driven by a right traction motor and the front and rear traction means on the left side of the cleaner are driven by a left traction motor. The speed and direction of the respective traction motors are controlled by the programmable controller. In turn, the programmable controller responds to signals transmitted by the one or more signal-generating sensors.

In one preferred embodiment, a pair of infrared source/detecting sensors are fitted in the opposing ends of cover 12 at a position corresponding to the longitudinal axis of the cleaner. As used herein, the longitudinal axis of the cleaner means the central axis taken along the line of advance of the cleaner. The infrared sensors should be placed on or very close to the longitudinal axis in order that the reflected beam not be detected should the cleaner become stopped at a corner of the pool, or by some other obstruction in or-along the pool from which the controller will reverse the direction of movement of the cleaner, as will be described in more detail below.

Referring again to FIG. 1, there is shown as an alternative, a fluid-flow sensor 40' that is mounted on an exterior surface of the cleaner housing 12. The fluid-flow sensor 40' can be constructed with an impeller 41 mounted for rotation when the cleaner moves through the water thereby generating a current or other form of signal, e.g., magnetic, that is received by the controller 34 for processing. Although a single mercury switch can be used in another preferred embodiment of the invention, one or more back-up sensors can be installed to provide the system with a measure of redundancy in the event that-one of the sensors fails or malfunctions.

Figure 3:
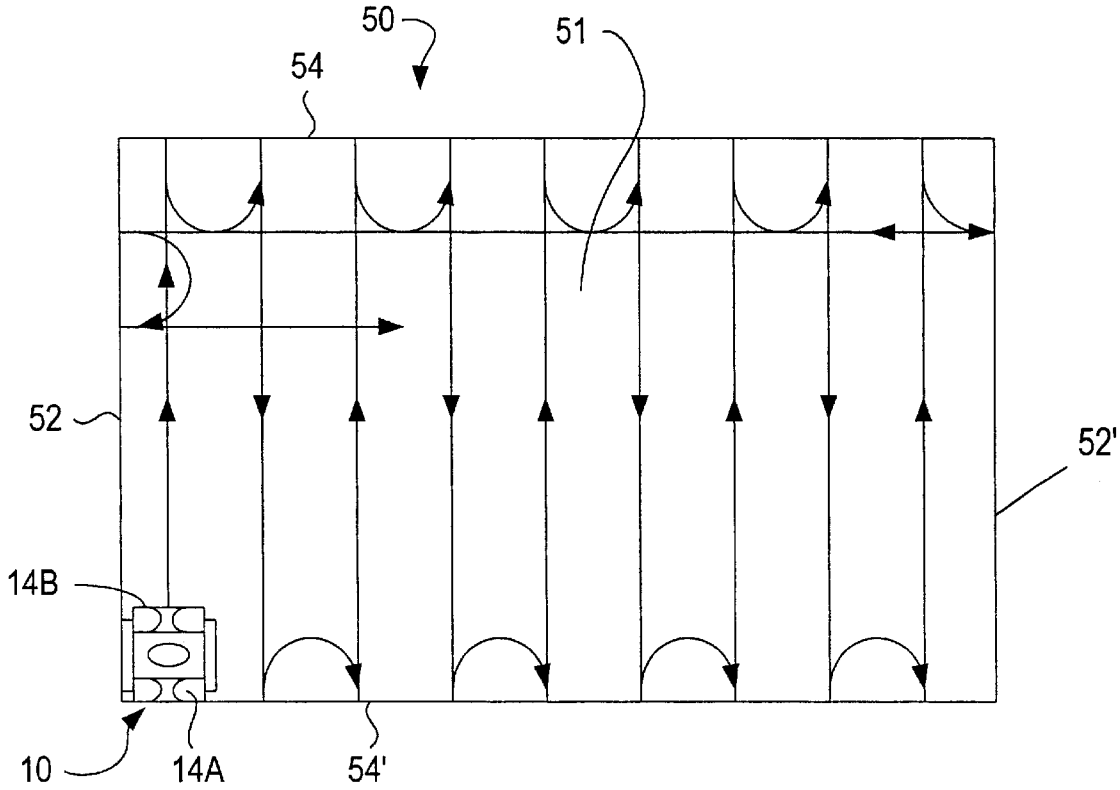
FIG. 3 is a plan view of a pool schematically illustrating the path of a pool cleaner in accordance with the invention.
Figure 5:
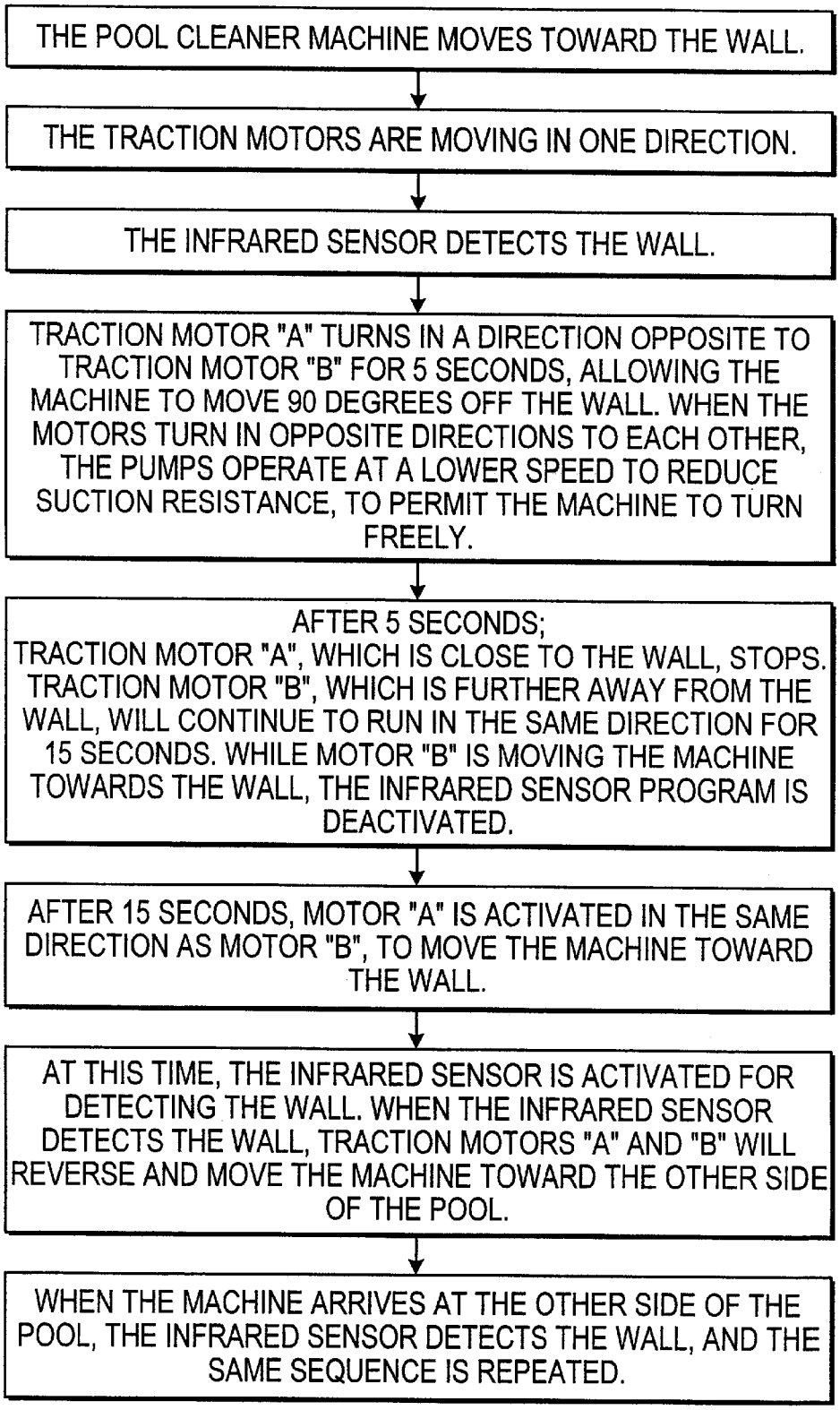
FIG. 5 is a block diagram schematically illustrating one embodiment of the method.

The practice of one preferred embodiment of the invention will be described with reference to FIG. 3 where there is schematically illustrated a plan view of a pool into which is placed a pool cleaner 10 of the invention. The cleaner 12 is placed in the lower left hand corner of the pool as represented in the illustration of FIG. 3, and in accordance with the invention is programmed to traverse the pool in a straight line parallel to end wall 52 across bottom 51. When the cleaner reaches wall 54 a sensor 40 generates a signal that is transmitted to controller 34 which causes both traction motors 30 to be deactivated or stopped. In this embodiment, reference will be to the assembly as illustrated in FIG. 2. Traction motor 30B is activated to move traction means 14B in a direction opposite to that used to traverse the pool on the first leg and to thereby move the cleaner away from wall 54. If traction motor 30A remains stopped, the cleaner will complete a U-turn, or an 180° turn, in a radius that is somewhat greater than the width of the cleaner body 12. In order to complete the 180° turn with a shorter radius, traction motor 30A can move traction means 14A in a direction toward wall 54. In a preferred embodiment, traction motor 30A is operated in this mode until about one-half or 90° of the turn has been completed. This sequence of the steps for the method is illustrated in the block diagram of FIG. 5. In the practice of the method of the invention, the controller 34 will be programmed to activate traction motor 30A for a prescribed period of time, which time is easily determined for each particular cleaner and the conditions found in the pool, and will be dependent upon such parameters as the speed at which the traction means are operated, the size of the traction means and their materials of construction, the nature of the pool surface, among other things.

When the cleaner has completed its first U-turn against wall 54, a signal is generated by the one or more sensors 40 that is transmitted to the controller, which then deactivates or stops traction motor 30B and thereafter activates both traction motors to move the cleaner away from wall 54 in a straight line that is parallel to the first track and which moves the cleaner towards wall 54'.

When the cleaner 10 reaches wall 54', the process is repeated, with the important exception that traction motor 30A is on the outside of the cleaner during the 180° U-turn. This sequence of turns is important to the successful practice of the method of the invention, particularly in larger pools, and especially in Olympic-size pools, because it avoids the twisting and tight coiling of the floating power cord. Thus, any twisting of the power cord is at most 180°, and because of the alternating turns is regularly untwisted.

With continued reference to FIG. 3, the regular transverse parallel pattern of the cleaner 10 continues until the final partial turn shown at the upper right hand side when the cleaner completes about half or 90° of the turn as it approaches end wall 52'. As the cleaner approaches the wall, the sensor 40 generates a signal that is transmitted to the controller 34 which deactivates and stops the traction motor 30B. Thereafter the controller activates both traction motors to move the cleaner 10 away from wall 52' along a straight line that is parallel to wall 50. When the cleaner reaches end wall 52 it commences the scanning pattern of 180° U-turns and parallel traverses of the pool bottom in the manner described above. In the event that the final traverse brings the cleaner into a partial turn in the lower left-hand corner of the pool, the cleaner will be slightly offset from its original traverse between walls 54' and 54; similarly, if the cleaner completes its final traverse at the lower right-hand corner of the pool, it will repeat its traversing pattern, in reverse, from right to left in this illustration.

Figure 4:
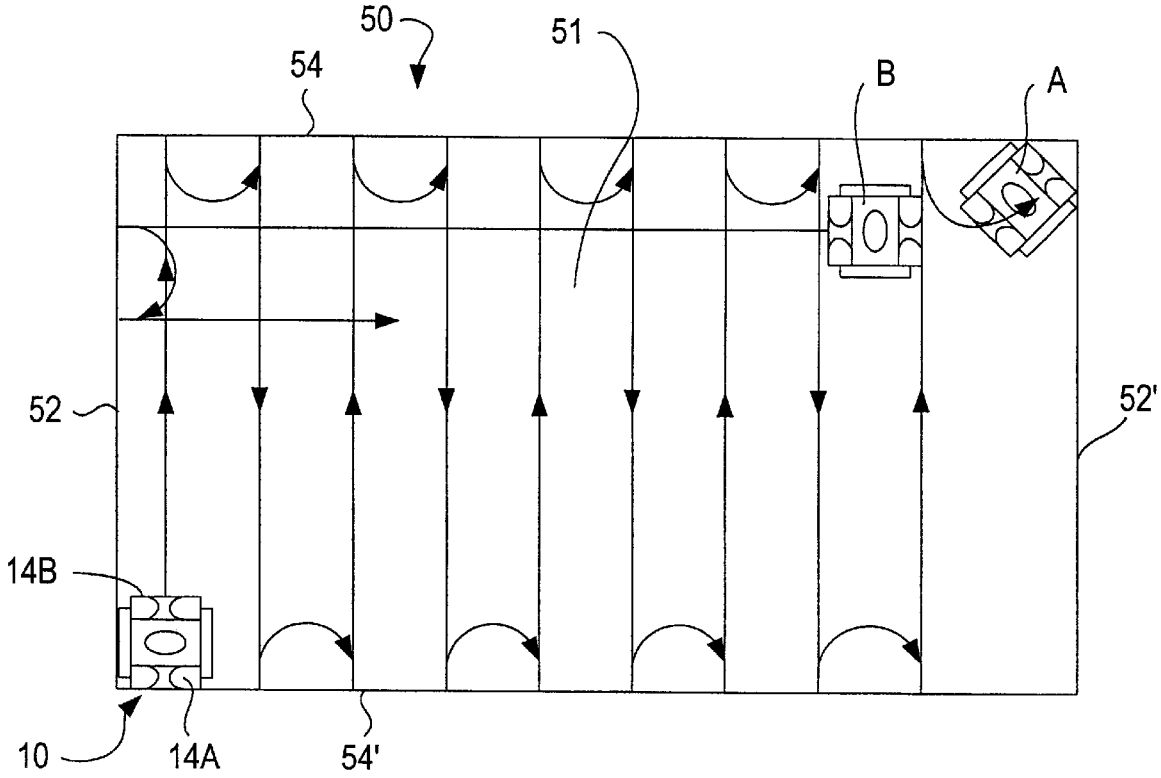
FIG. 4 is a plan view similar to FIG. 2 illustrating anther embodiment of the invention.
Figure 6:
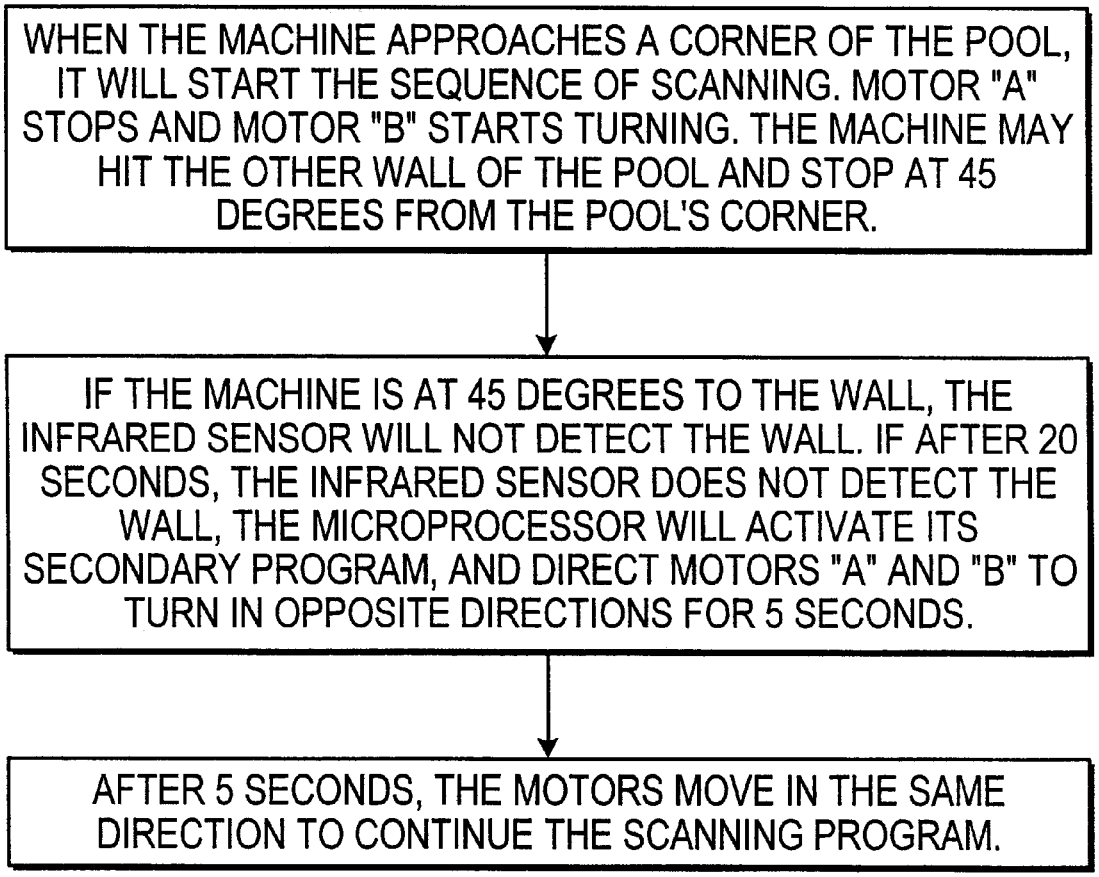
FIG. 6 is a block diagram schematically illustrating another embodiment of the invention.

A further important feature of the apparatus and method of the invention is illustrated in the schematic plan view of FIG. 4. In this illustration, the cleaner 10 has completed any number of parallel traverses between walls 54 and 54', but the final turn is greater than 90° but less than 180°, leaving the cleaner immobilized in the upper right hand corner formed by walls 54 and 52'. In the preferred embodiment of the invention that is best adapted to return the cleaner to a regular traversing path, the one or more sensors 40 are of the infrared or mercury switch type. In either event, when the cleaner 10 is in the position A as shown in FIG. 4, the infrared sensor cannot "see" its reflected beam and therefore will generate no signal to be transmitted to the controller. Likewise, the cleaner equipped with a mercury switch cannot climb either wall, and its one or more mercury switches remain in the horizontal position. In order to return the cleaner to a regular scanning pattern, the controller is programmed to initiate a timer at the commencement of each U-turn, and if no signal is received within a prescribed period of the time that would be sufficient to have completed a U-turn, the controller stops the advance of the traction means and then reactivates the outer traction means, which in this instance would be traction means 14B for a second shorter predetermined period of time to bring the longitudinal axis of the cleaner parallel to sidewall 54, at which point the traction motor 30B is deactivated or stopped. Thereafter, the controller activates both traction motors to advance the cleaner away from wall 52' to assume a path that is similar to that shown in FIG. 3. The sequence of steps employed in the practice of this method of the invention are illustrated in the block diagram of FIG. 6.

From the above description, it will be understood that the invention provides an apparatus and method that systematically cleans the bottom of a pool in a pattern that is much more efficient than any random pattern known to the art. Furthermore, the use of a microprocessor or electronic programmable controller is much more cost effective and provides a significant cost savings as compared to the gyroscopically guided cleaners of the prior art. The invention can be adapted for use in various models of cleaners known in the art which can be retrofitted with the sensors, microprocessors, wiring changes and, if required, synchonizable motors. When programmed for scanning in accordance with the method of the invention, corking or twisting of the floating power cord is avoided, or so minimized that there is no interference with the prescribed scanning movement of the cleaner.

We claim:

1. A robotic cleaner for cleaning a pool or tank having a bottom and first and second opposing side walls, said cleaner comprising:

a housing having opposing first and second ends and opposing first and second sides extending from said first end to said second end;

first and second traction means mounted for independent rotation at said first end, said first traction means being adjacent said first side and said second traction means being adjacent said second side;

third and fourth traction means mounted for independent rotation at said second end, said third traction means being adjacent said first side and said fourth traction means being adjacent said second side;

a first traction motor connected to drive said first and third traction means to cause motion of said cleaner across the bottom of the pool or tank;

a second traction motor connected to drive said second and fourth traction means to cause motion of said cleaner across the bottom of the pool or tank;

at least one signal-generating sensor; and a programmable electronic controller operatively connected to said at least one sensor and to said first and second traction motors for controlling independent activation and deactivation of said first and second traction motors in response to signal information generated by said at least one sensor, wherein, in a first operation, said controller is responsive, while both said first and second traction motors are activated to cause motion of said cleaner across the bottom toward the first sidewall, to first signal information from said at least one sensor indicating that said first end of said cleaner is proximate the first side wall to deactivate both said first and second traction motors to stop motion of said cleaner;

wherein, in a second operation following said first operation, said controller activates a selected one, of said first and second traction motors while said first end of said cleaner is proximate said first side wall, the second operation bringing said second end of said cleaner proximate said first side wall;

wherein, in a third operation following said second operation, said controller is responsive to second signal information from said at least one sensor indicating that said second end of said cleaner is proximate the first side wall to deactivate the selected one of said first and second traction motors; and wherein, in a fourth operation following said third operation, said controller activates both of said first and second traction motors to cause motion of said cleaner away from said first side wall.

2. The cleaner of claim 1, wherein said controller independently controls speeds of said first and second traction motors, said controller controlling said first and second traction motors to have essentially a same speed while said cleaner is moving across the bottom from one of the first and second side walls to the other of the first and second sidewalls.

3. The cleaner of claim 1, wherein said at least one sensor comprises a sensor selected from the group consisting of infrared, magnetic field, fluid flow, mercury switch and mechanical position sensors.

4. The cleaner of claim 1, wherein said at least one sensor comprises a first infrared sensor positioned at said first end of said cleaner and a second infrared sensor positioned at said second end of said cleaner, said first and second infrared sensors being aligned with a longitudinal axis of said cleaner.

5. The cleaner of claim 1, wherein each of said first and second traction means is selected from the group consisting of roller brushes, endless traction belts and wheels.

6. The cleaner of claim 1, wherein each of said first and second traction means comprises axle mounted roller brushes connected to the respective traction motors by pulley-mounted drive belts.

7. The cleaner of claim 1, wherein each of said first and second traction motors is a DC brushless motor.

8. The cleaner of claim 1, further comprising a water pump mounted on said housing and means for controlling a volumetric discharge of said water pump when said cleaner is proximate one of the first and second sidewalls.

9. The cleaner of claim 8, wherein said means for controlling the volumetric discharge reduces a volume of water discharged from said pump when said cleaner is proximate one of the first and second sidewalls.

10. The cleaner of claim 8, wherein said means for controlling the volumetric discharge reduces a volume of water discharged from said pump when said cleaner is turning proximate one of the first and second sidewalls.

11. The cleaner of claim 10, wherein the reduced volume of said pump is sufficient to maintain said first and second traction means in contact with the bottom of the pool or tank.

12. The cleaner of claim 1, wherein activation of both of said first and second traction motors at a same speed causes said cleaner to move in a straight line.

13. The cleaner of claim 1, wherein activation of a single one of said first and second traction motors causes said cleaner to move in an arcuate path.

14. The cleaner of claim 1, wherein, during said second operation, the one of said first and second traction motors not selected is stationary.

15. The cleaner of claim 1, wherein when, after said third operation and before said fourth operation, said at least one sensor indicates that said second end of said cleaner has advanced up the first side wall to position said cleaner at an angle that is greater than about 30° to horizontal, said controller activates the selected one of said first and second traction means in a direction opposite to a direction in said second operation to move said cleaner down the first side wall to a position on the bottom of the pool or tank, said controller being thereafter responsive to signal information from said at least one sensor that said cleaner is on the bottom of the pool or tank to deactivate the selected one of said first and second traction means.

16. A method of operating a robotic cleaner for cleaning a pool or tank having a bottom and first and second opposing side walls, the cleaner comprising a housing having opposing first and second ends and opposing first and second sides extending from said first end to said second end, first and second traction means mounted for independent rotation at said first end, said first traction means being adjacent said first side and said second traction means being adjacent said second side, third and fourth traction means mounted for independent rotation at said second end, said third traction means being adjacent said first side and said fourth traction means being adjacent said second side, a first traction motor connected to drive said first and third traction means to cause motion of said cleaner across the bottom of the pool or tank, a second traction motor connected to drive said second and fourth traction means to cause motion of said cleaner across the bottom of the pool or tank, at least one signal-generating sensor, and a programmable electronic controller operatively connected to said at least one sensor and to said first and second traction motors for controlling independent activation and deactivation of said first and second traction motors in response to signal information generated by said at least one sensor, said method comprising the steps of:

in a first operation, while both said first and second traction motors are activated to cause motion of said cleaner across the bottom toward the first sidewall, causing said controller to be responsive to first signal information from said at least one sensor indicating that said first end of said cleaner is proximate the first side wall to deactivate both said first and second traction motors to stop motion of said cleaner;

in a second operation following said first operation, causing said controller to activate a selected one of said first and second traction motors while said first end of said cleaner is proximate said first side wall, the second operation bringing said second end of said cleaner proximate said first side wall;

in a third operation following said second operation, causing said controller to be responsive to second signal information from said at least one sensor indicating that said second end of said cleaner is proximate the first side wall to deactivate the selected one of said first and second traction motors; and in a fourth operation following said third operation, causing said controller to activate both of said first and second traction motors to cause motion of said cleaner away from said first side wall.

17. The method of claim 16, wherein when, after said third operation and before said fourth operation, said at least one sensor indicates that said second end of said cleaner has advanced up the first side wall to position said cleaner at an angle that is greater than about 30° to horizontal, said method comprises the additional steps of causing said controller to activate the selected one of said first and second traction means in a direction opposite to a direction in said second operation to move said cleaner down the first side wall to a position on the bottom of the pool or tank, and causing said controller to be thereafter responsive to signal information from said at least one sensor that said cleaner is on the bottom of the pool or tank to deactivate the selected one of said first and second traction means.

* * * * *